US007454999B2

(12) United States Patent
Wu

(10) Patent No.: US 7,454,999 B2
(45) Date of Patent: Nov. 25, 2008

(54) LOCKING PLIERS

(76) Inventor: Ming-chieh Wu, No. 20, Shude 1st Lane, South District, Taichung City 402 (TW)

( * ) Notice: Subject to any disclaimer, the term of this patent is extended or adjusted under 35 U.S.C. 154(b) by 0 days.

(21) Appl. No.: 11/676,293

(22) Filed: Feb. 18, 2007

(65) Prior Publication Data

US 2008/0196561 A1 Aug. 21, 2008

(51) Int. Cl.
*B25B 7/12* (2006.01)

(52) U.S. Cl. ..... 81/367; 81/370

(58) Field of Classification Search ..... 81/367–384
See application file for complete search history.

(56) References Cited

U.S. PATENT DOCUMENTS 2,838,973 A * 6/1958 Petersen ..... 81/370
2002/0162427 A1* 11/2002 Peperkorn et al. ..... 81/370
2007/0209484 A1* 9/2007 Chervenak et al. ..... 81/368

* cited by examiner

*Primary Examiner*—D. S Meislin
(74) *Attorney, Agent, or Firm*—Banger Shia

(57) ABSTRACT

A restricting member with an engaging structure for a pair of locking pliers comprises a first pivoting portion, a second pivoting portion and the engaging structure. The engaging structure extends out of an upper part of the restricting member, so that it can be positioned in a groove of a side handle, and makes a supporting portion of a linking member press against the groove of the side handle. The restricting member not only saves space and cost for it needs no additional subassemblies, but also makes the assembling work more convenient.

1 Claim, 7 Drawing Sheets

LOCKING PLIERS

BACKGROUND OF THE INVENTION

1. Field of the Invention

The present invention relates to a pair of locking pliers, and more particularly to an engaging structure for a pair of locking pliers.

2. Description of the Prior Art

A pair of locking pliers of an U.S. Pat. No. 6,626,070, as shown in FIG. 1, comprises a fixed handle P1, an adjustable jaw P2, a side handle P3, an elastic member P4, a restricting member P5 and a linking member P6.

The fixed handle P1 is provided with a U-shaped groove P101. One end of the fixed handle P1 is defined with a receiving portion P11 in which is screwed a supporting member P111 that is aligned with the groove P101, and one end of the receiving portion P11 is connected to a gripping portion P12. A hook-shaped rib is formed in the middle section of the bottom of the groove P101, which is aligned with the gripping portion P12. One end of the gripping portion is connected to a pivoting portion P13, and one end of the pivoting portion P13 is connected to a clamping portion P14.

The clamping portion P21 is formed on an end of the adjustable jaw P2, and a first pivoting portion P22 and a second pivoting portion P23 are formed on another end of the adjustable jaw P2 respectively. The first pivoting portion P22 is pivotally connected with the pivoting portion P13 of the fixed handle P1.

The side handle P3 is provided with a U-shaped groove P301. On one end of the side handle P3 is defined with a first pivoting portion P31 and a second pivoting portion P32, which are arranged close to each other. The first pivoting portion P31 of the side handle P3 is pivotally connected with the second pivoting portion P23 of the adjustable jaw P2, and one end of the second pivoting portion P32 of the side handle P3 is connected with a pressing portion P33. A stopping subassembly P34 is arranged in the middle section of the groove P301 and is aligned with the pressing portion P33.

One end of the elastic member P4 is hooked on the hook-shaped rib P121 of the fixed handle, and another end is hooked between the first pivoting portion P22 and the second pivoting portion P23 of the adjustable jaw P2.

The restricting member P5 is provided with a U-shaped groove P501. On one end of the restricting member P5 is defined with a first pivoting portion P51 and a second pivoting portion P52, which are arranged close to each other. A sheet-shaped restricting portion P53 is formed at the other end of the restricting member P5 to cooperate with the stopping subassembly P34 of the side handle P3 to form an engaging structure. The first pivoting portion P51 of the restricting member P5 and the second pivoting portion P32 of the side handle P3 are pivotally connected and arranged in the groove 301 of the side handle P3.

The linking member P6 is T-shaped. On one end of the linking member P6 is defined with a pivoting portion P61, and on another end is defined with a locking portion P62. A supporting portion P63 that is aligned with the bottom of the groove P301 of the side handle P3 is defined in the middle section of the linking member P6. The pivoting portion P61 of the linking member P6 is arranged in the groove P501 of the restricting member P5 and is pivotally connected with the second pivoting portion P52 of the restricting member P5.

The following is an illustration of the operation and the function of the pair of locking pliers. When the side handle P3 is pulled outward to leave the P1, the restricting member P5 utilizes the stopping subassembly P34 to stop the displacement of the restricting portion P53 through the first pivoting portion P51. When the side handle P3 is closed, the restricting member P5 drives the linking member P6 through the first pivoting portion P51 and the second pivoting portion P32, and the locking portion P62 of the linking member P6 is stopped by the supporting member P111 of the fixed handle P1, so that the linking member P6 can move relative to the side handle P3 through the pivoting portion P61, and the restricting portion P53 of the restricting member P5 pressed by supporting portion P63 of the linking member P6 is positioned the groove P301 of the side handle P3. However, after analyzing, the restricting member P6 of the pair of locking pliers has the following disadvantagements:

The restricting portion P53 of the restricting member P5 is formed and moves between the groove P301 of the side handle P3 and the stopping subassembly P34, so that the restricting portion P53 of the restricting member P5 takes up a relatively larger space of the groove P301 of the side handle P3. In addition, the restricting portion P53 of the restricting member P5 should cooperate with a stopping subassembly P34 and that increases the cost and makes the assembling work more inconvenient. How to design an easily assembled and low cost restricting member P5 becomes an important point in research.

The present invention has arisen to mitigate and/or obviate the afore-described disadvantages.

SUMMARY OF THE INVENTION

The primary objective of the present invention is to provide an engaging structure formed in an upper part of a restricting member that is positioned in a groove of a side handle so as to save space and cost, and make assembling work more convenient.

In order to achieve above-mentioned objective, a pair of locking pliers in accordance with the present invention comprises a fixed handle with a groove, an adjustable jaw, a side handle with a groove, an elastic member, a restricting member with a groove and a linking member with a supporting portion. The restricting member includes a first pivoting portion that engages in a groove of a side handle, a groove of a second pivoting portion provided for engaging with a linking member, and the second pivoting portion being connected in a groove of a fixed handle and an engaging structure corresponding to the groove of the side handle. The engaging structure extends out of the upper part of the restricting member, so that it can be positioned in the groove of the side handle.

By such arrangements, the restricting member not only saves space and cost for it needs no additional subassemblies, but also makes the assembling work more convenient.

DETAILED DESCRIPTION OF THE PREFERRED EMBODIMENTS

Figure 1:
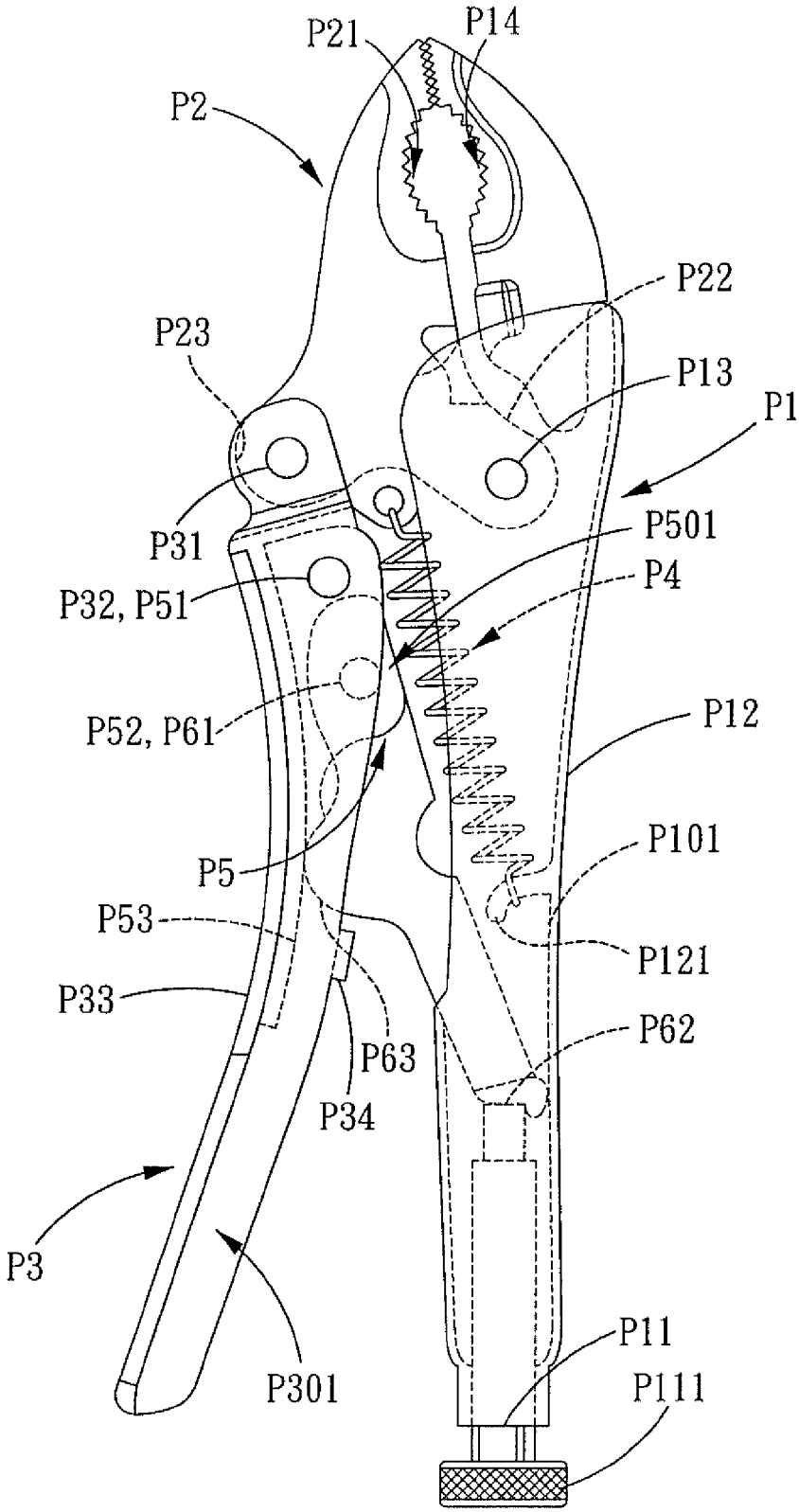
FIG. 1 PRIOR ART
FIG. 1 is an assembly view of a pair of conventional locking pliers.

The present invention will be more clear from the following description when viewed together with the accompanying drawings, which show, for purpose of illustrations only, the preferred embodiment in accordance with the present invention.

Referring to FIGS. 2-7, a pair of locking pliers in accordance with the present invention comprises a fixed handle 1, an adjustable jaw 2, a side handle 3, an elastic member 4, a restricting member 5 and a linking member 6.

The fixed handle 1 is provided with a U-shaped groove 101. A receiving portion 11 is defined at one end of the fixed handle 1. A supporting member 111 that is aligned with the groove 101 is screwed in the receiving portion 11. One end of the receiving portion 11 is connected with a holding portion 12, and a hook-shaped rib 121 is formed in the middle section of the bottom of the groove 101. One end of the holding portion 12 connects a pivoting portion 13, and one end of the pivoting portion 13 is connected with a clamping portion 14.

A clamping portion 21 is formed on an end of the adjustable jaw 2, and a first pivoting portion 22 and a second pivoting portion 23 are formed at both sides of the other end of the adjustable jaw 2. The first pivoting portion 22 is pivotally connected with the pivoting portion 13 of the fixed handle 1.

The side handle 3 is provided with a U-shaped groove 301. On one end of the side handle 3 is defined with a first pivoting portion 31 and a second pivoting portion 32, which are arranged close to each other. The first pivoting portion 31 of the side handle 3 is pivotally connected with the second pivoting portion 23 of the adjustable jaw 2, and one end of the second pivoting portion 32 of the side handle 3 is connected with a pressing portion 33.

One end of the elastic member 4 is hooked on the hook-shaped rib 121 of the fixed handle, and another end is hooked between the first pivoting portion 22 and the second pivoting portion 23 of the adjustable jaw 2.

The restricting member 5 is provided with a U-shaped groove 501. On one end of the restricting member 5 is defined with a first pivoting portion 51 and a second pivoting portion 52, which are arranged close to each other. An engaging structure 53 extends out of the side of the first pivoting portion 51. The first pivoting portion 51 of the restricting member 5 and the second pivoting portion 32 of the side handle 3 are pivotally connected and arranged in the groove 301 of the side handle 3.

The linking member 6 is T-shaped. On one end of the linking member 6 is defined with a pivoting portion 61, and on another end is defined with an engaging portion 62. A supporting portion 63 to be pressed against the bottom of the groove 301 of the side handle 3 is defined in the middle section of the linking member 6. The pivoting portion 61 of the linking member 6 is arranged in the groove 501 of the restricting member 5 and is pivotally connected with the second pivoting portion 52 of the restricting member 5.

The following is an illustration of two forms A and B of the engaging structure 53.

Figure 2:
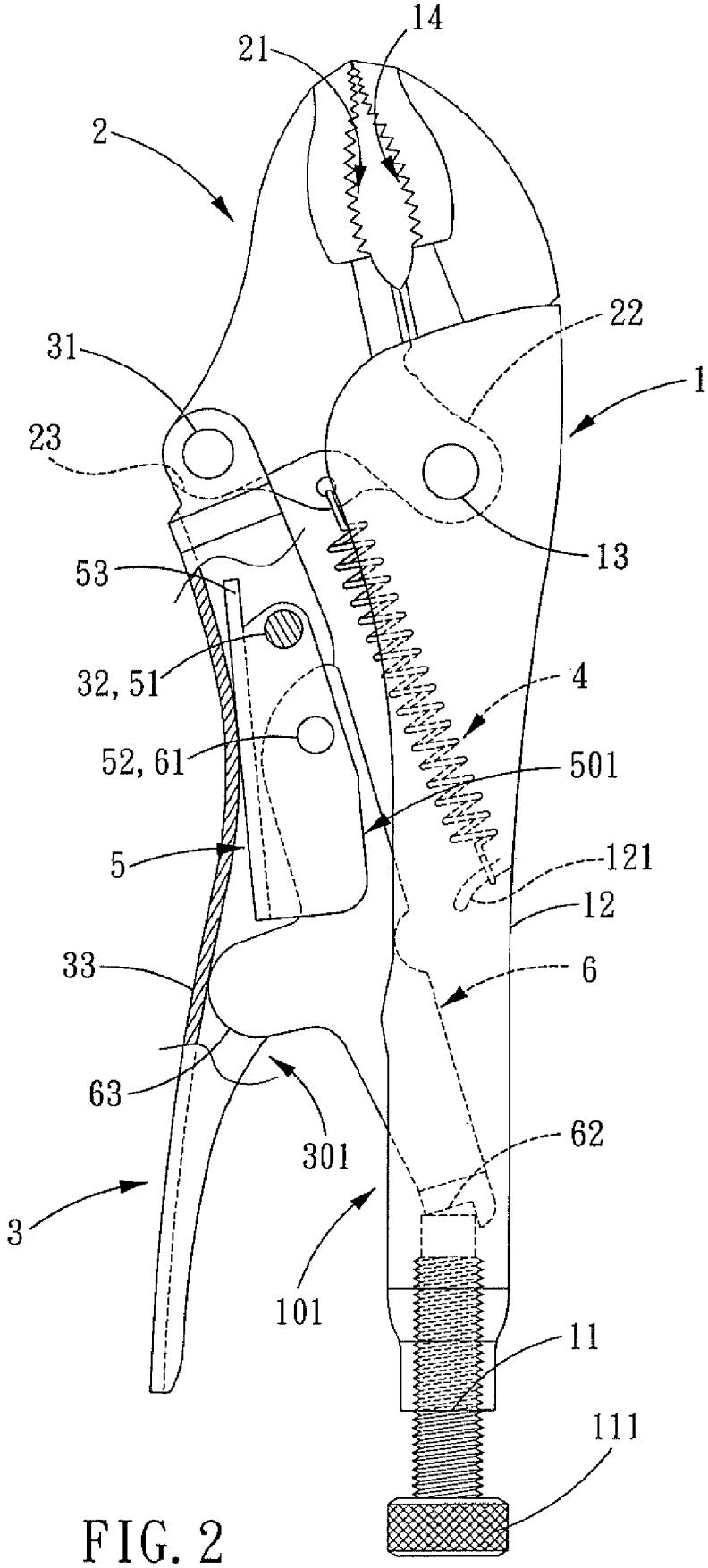
FIG. 2 is a first perspective assembly view of a pair of locking pliers in accordance with the present invention.
Figure 3:
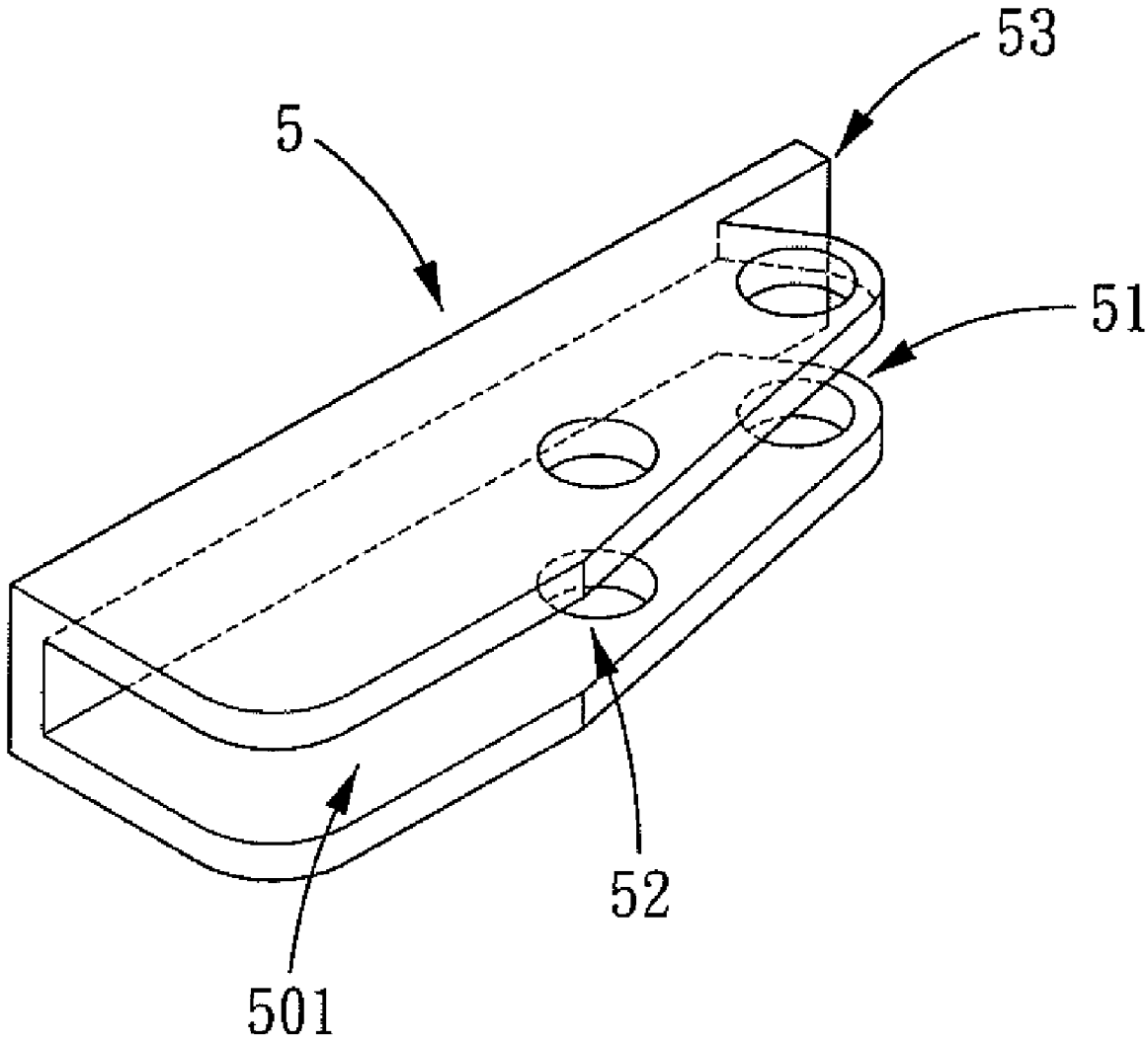
FIG. 3 is a first perspective view of the restricting member in accordance with the present invention.
Figure 4:
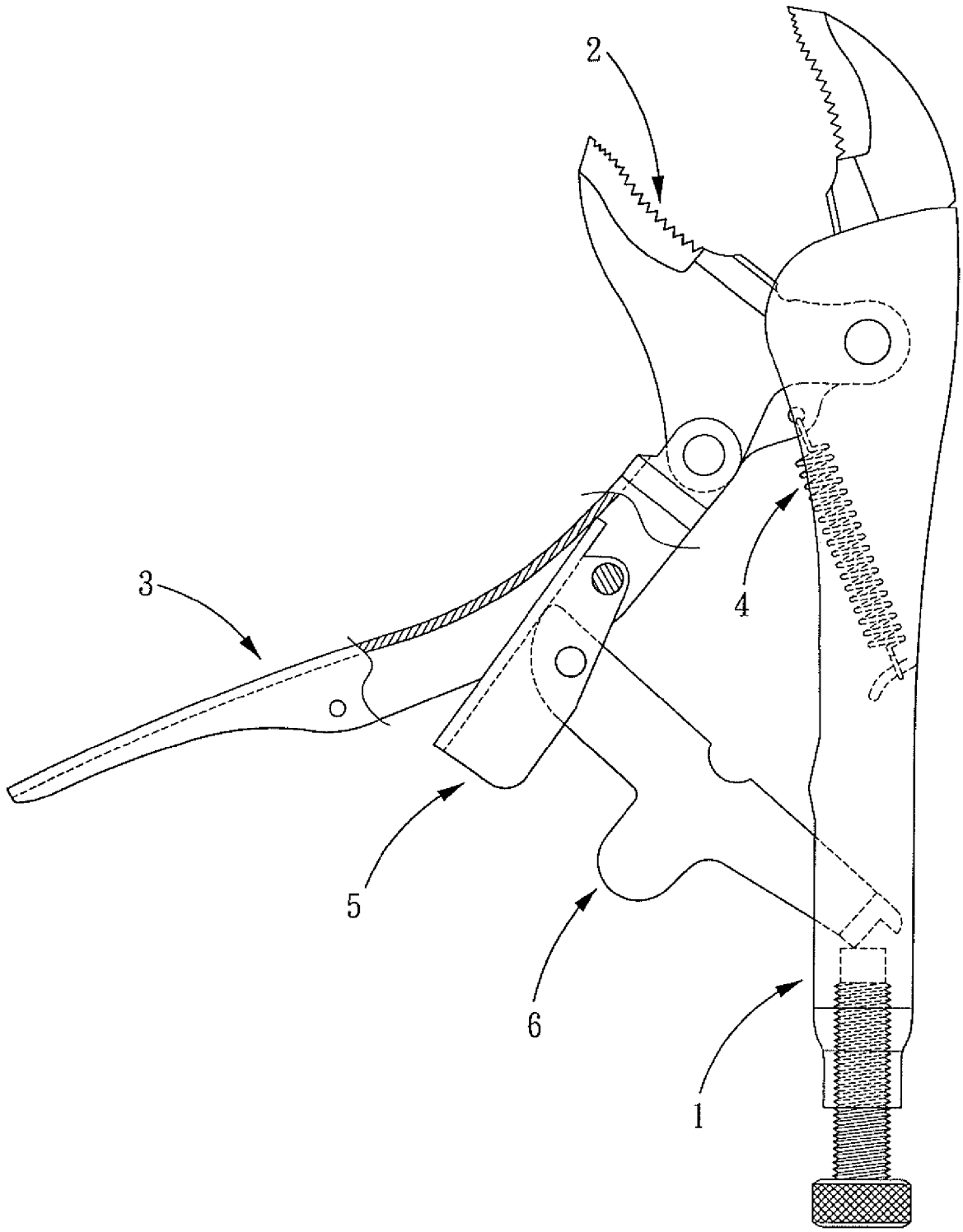
FIG. 4 is a first perspective view of showing that the engaging structure of the restricting member in accordance with the present invention.

A. The engaging structure 53 of the restricting member 5 (as shown in FIGS. 2-4) is sheet-shaped and extends out of the bottom of the groove 501, and the engaging structure 53 is positioned against the bottom of the groove 301 of the side handle 3.

Figure 5:
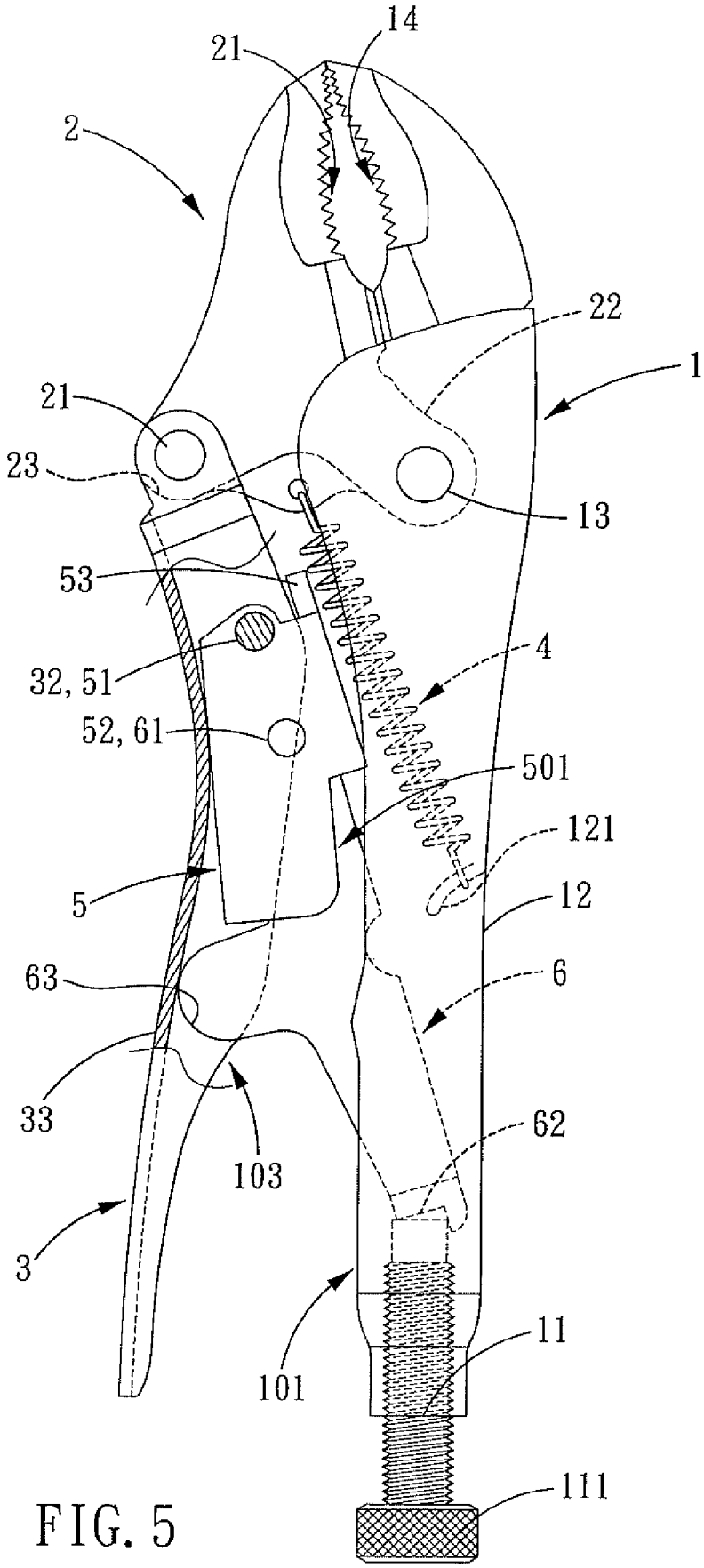
FIG. 5 is a second perspective assembly view of the pair of locking pliers in accordance with the present invention.
Figure 6:
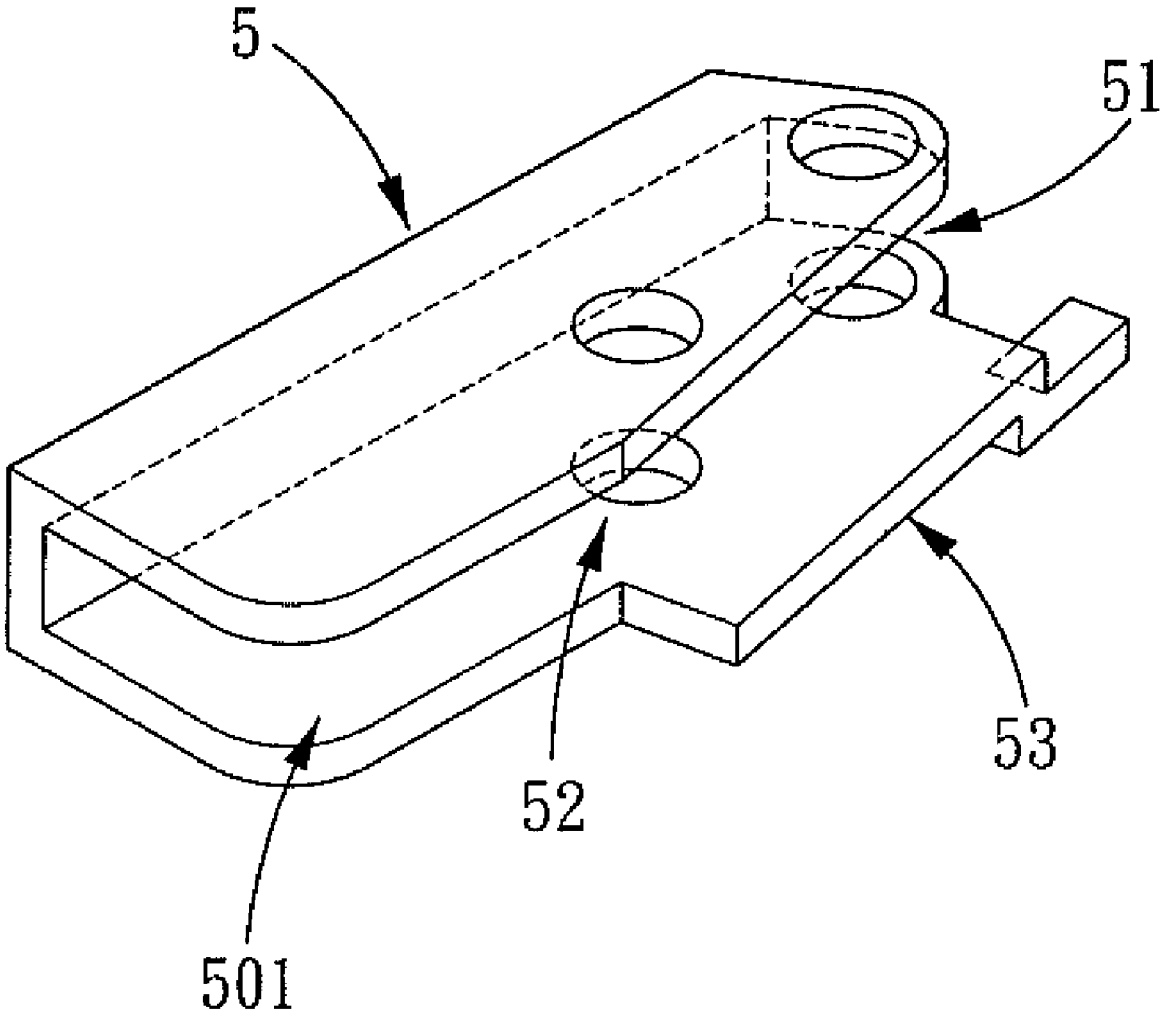
FIG. 6 is a second perspective view of the restricting member in accordance with the present invention.
Figure 7:
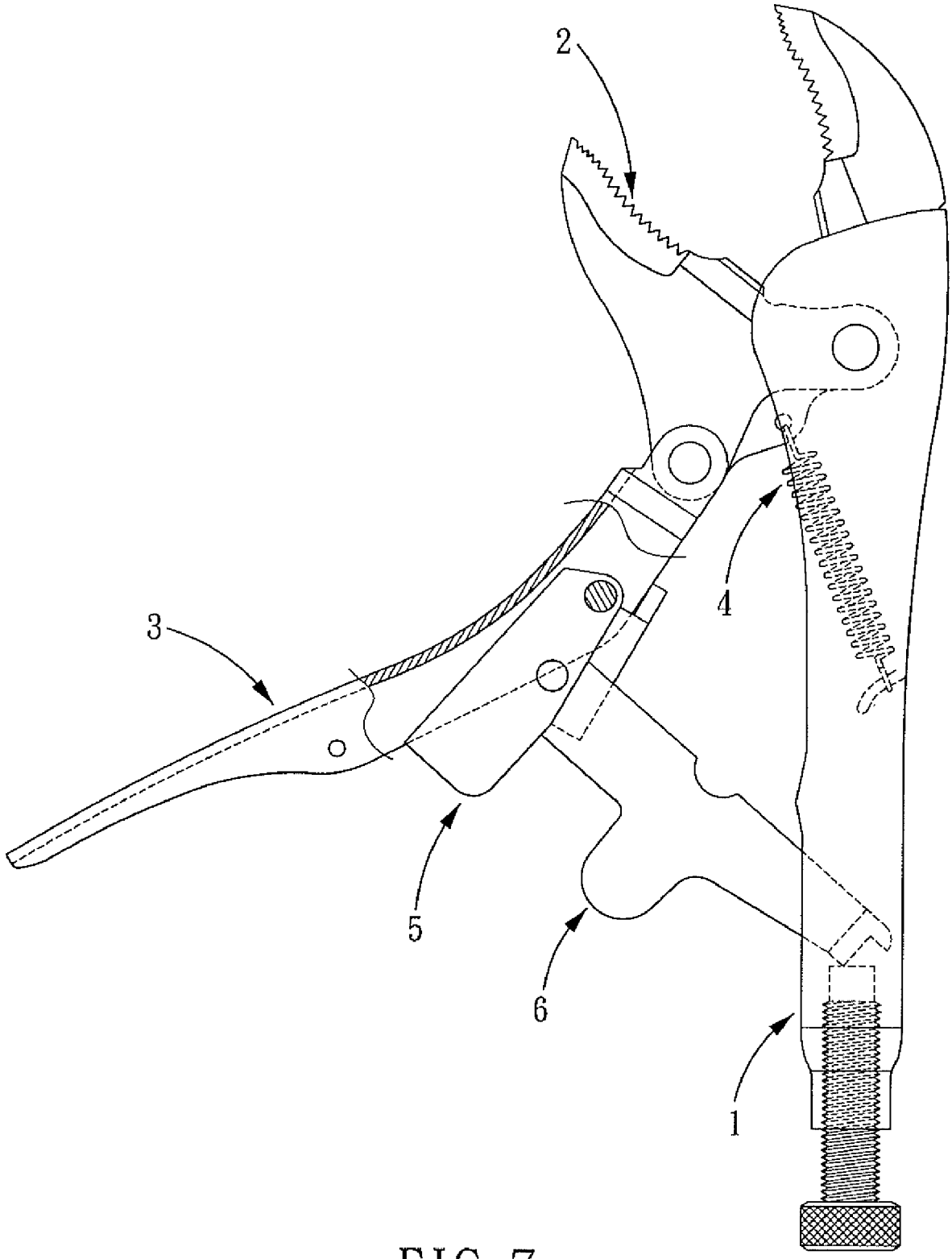
FIG. 7 is a second perspective view of showing that the engaging structure of the restricting member in accordance with the present invention.

B. The engaging structure 53 of the restricting member 5 (as shown in FIGS. 5-7) is Z-shaped and extends from a top edge of one side of the bottom of the groove 501, and the engaging structure 53 is positioned against the top edge of one side of the groove 301 of the side handle 3, so as to prevent the side handle and the fixed handle from being further pried apart.

For a better understanding of the present invention, its operation and function, reference should be made to FIGS. 2-7, when the side handle 3 is pulled outward to leave the fixed handle 1, the restricting member 5 utilizes the engaging structure 53 positioned in the groove 301 to restrict the displacement of the side handle 3, and the engaging structure 53 of the restricting member 5 is directly positioned against of the groove 301 or one side of the bottom of the groove 301. When the side handle 3 is closed, the restricting member 5 drives the linking member 6 through the first pivoting portion 51 and the second pivoting portion 32, and the locking portion 62 of the linking member 6 is stopped by the supporting member 111 of the fixed handle 1, so that the linking member 6 can move relative to the side handle 3 through the pivoting portion 61, and the supporting portion 63 of the linking member 63 engages with the bottom of the groove 301.

The above illustration shows that the engaging structure 53 of the restricting member 5 is directly positioned in the groove 301 of the side handle 3. By such arrangements, the engaging structure 53 of the restricting member 5 will not take an assembling space of the groove 301 of the side handle 3, so it saves space. In addition, the engaging structure 53 of the restricting member 5 needs no additional subassemblies, so it reduces cost and makes assembling work more convenient.

To sum up, the restricting member in accordance with the present invention comprises a first pivoting portion to be inserted and pivotally connected in the groove of the side handle, a linking member is pivotally connected in a groove of a second pivoting portion of the restricting member, and the second pivoting portion lies in a groove of a fixed handle and an engaging structure is positioned against the groove of the side handle. The engaging structure of the restricting member extends out of the upper part of the restricting member, so that it can be positioned in the groove of the side handle, and makes a supporting portion of the linking member to press against the groove of the side handle. The restricting member not only saves space and cost for it needs no additional subassemblies, but also makes the assembling work more convenient.

While we have shown and described various embodiments in accordance with the present invention, it is clear to those skilled in the art that further embodiments may be made without departing from the scope of the present invention.

What is claimed is:

1. An engaging structure for a pair of locking pliers, comprising:

a fixed handle with a groove, an adjustable jaw, a side handle with a groove, an elastic member, a restricting member with a groove and a linking member with a supporting portion, the restricting member including a first pivoting portion to be inserted and pivotally connected in the groove of the side handle, the linking member being arranged in the groove of the restricting member and pivotally connected with a second pivoting portion of the restricting member, and the second pivoting portion lies in the groove of the side handle; characterized in that:

an engaging structure of the restricting member extends from a top edge of one side of the groove of the restricting member;

when the pair of locking pliers is open, the engaging structure is positioned against a top edge of one side of the groove of the side handle, so as to prevent the side handle and the fixed handle from being further pried apart, and when the pair of locking pliers are closed, the supporting portion of the linking member is pressed against the groove of the side handle;

the engaging structure of the restricting member is Z-shaped.

* * * * *